US009476390B2

(12) United States Patent
Nishimura et al.

(10) Patent No.: US 9,476,390 B2
(45) Date of Patent: Oct. 25, 2016

(54) INTAKE SYSTEM FOR A VEHICLE, AND ENGINE INCLUDING SAME

(71) Applicant: HONDA MOTOR CO., LTD., Minato-Ku, Tokyo (JP)

(72) Inventors: Shin Nishimura, Saitama (JP); Masahiro Kontani, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 263 days.

(21) Appl. No.: 14/098,686

(22) Filed: Dec. 6, 2013

(65) Prior Publication Data

US 2014/0182556 A1 Jul. 3, 2014

(30) Foreign Application Priority Data

Dec. 27, 2012 (JP) ..... 2012-285985

(51) Int. Cl.

| | |
|---|---|
| ***F02M 35/10*** | (2006.01) |
| ***F02M 35/104*** | (2006.01) |
| ***F02M 35/116*** | (2006.01) |
| ***F02M 35/16*** | (2006.01) |
| *F02M 61/14* | (2006.01) |
| *F02D 9/10* | (2006.01) |

(52) U.S. Cl.

CPC ..... *F02M 35/10242* (2013.01); *F02M 35/104* (2013.01); *F02M 35/116* (2013.01); *F02M 35/162* (2013.01); *F02M 61/145* (2013.01); *F02D 9/107* (2013.01); *F02M 61/14* (2013.01)

(58) Field of Classification Search

CPC ..... F02M 35/024; F02M 35/02416; F02M 35/02425; F02M 35/10242; F02M 35/10288; F02M 35/104; F02M 35/116; F02M 35/162; F02D 9/107

USPC ..... 123/184.21, 184.31, 184.34, 198 E, 336, 123/337, 470

See application file for complete search history.

(56) References Cited

U.S. PATENT DOCUMENTS

| | | | | |
|---|---|---|---|---|
| 6,422,201 | B1 * | 7/2002 | Yamada | F02B 27/06 123/184.53 |
| 6,609,367 | B2 * | 8/2003 | Nakayasu | F01N 3/28 137/625.19 |
| 6,655,134 | B2 * | 12/2003 | Nakayasu | F01N 3/28 251/214 |
| 7,066,135 | B2 * | 6/2006 | Ishikawa | F02M 35/10039 123/198 E |
| 7,086,364 | B2 * | 8/2006 | Udono | F02D 9/109 123/184.21 |

(Continued)

FOREIGN PATENT DOCUMENTS

JP 4421941 B2 2/2010

*Primary Examiner* — Stephen K Cronin
*Assistant Examiner* — Kevin R Steckbauer
(74) *Attorney, Agent, or Firm* — Carrier Blackman & Associates, P.C.; William D. Blackman; Anne G. Sabourin

(57) ABSTRACT

An intake system for a vehicle includes an air cleaner assembly in a compact size. Intake passages introduce intake air to front and rear cylinder blocks of a multicylinder engine, and an air cleaner assembly is connected to upstream ends of the intake passages. A space inside an air cleaner case of the air cleaner assembly is partitioned into upper and lower sides by a partition wall, forming a clean chamber above the partition wall and a dirty chamber below. The intake passages are arranged to pass through the dirty chamber in an up-down direction, and inlets of the intake passages are arranged in the clean chamber. A through hole is formed in the partition wall between the intake passages for the front and rear cylinder blocks. An air cleaner element, configured to clean incoming intake air, is arranged to occlude the through hole.

20 Claims, 7 Drawing Sheets

(56) References Cited

U.S. PATENT DOCUMENTS

| | | | | |
|---|---|---|---|---|
| 7,104,236 | B2 * | 9/2006 | Ishikawa | F02B 61/02 123/184.31 |
| 7,380,624 | B2 * | 6/2008 | Momosaki | F02M 35/10013 180/68.3 |
| 7,389,758 | B2 * | 6/2008 | Yokoi | F02B 27/0231 123/184.53 |
| 7,730,865 | B2 * | 6/2010 | Yokoi | F02B 27/0231 123/184.21 |
| 7,735,463 | B2 * | 6/2010 | Fujimura | F02M 35/10039 123/184.55 |
| 7,967,092 | B2 * | 6/2011 | Fujimura | F02M 35/10039 123/184.55 |
| 8,133,292 | B2 * | 3/2012 | Morita | B62K 11/04 123/198 E |
| 8,191,515 | B2 * | 6/2012 | Kontani | F02B 61/02 123/184.31 |
| 8,833,326 | B2 * | 9/2014 | Koyama | F02M 35/162 123/184.57 |
| 9,016,254 | B2 * | 4/2015 | Tanaka | F02M 35/10373 123/184.53 |
| 2014/0041614 | A1 * | 2/2014 | Koyama | F02M 35/10 123/184.21 |
| 2015/0159604 | A1 * | 6/2015 | Nishimura | B62K 11/04 123/198 E |
| 2015/0192097 | A1 * | 7/2015 | Nishimura | F02M 55/02 123/468 |

* cited by examiner

INTAKE SYSTEM FOR A VEHICLE, AND ENGINE INCLUDING SAME

CROSS-REFERENCE TO RELATED APPLICATIONS

The present invention claims priority under 35 USC 119 based on Japanese patent application No. 2012-285985, filed on Dec. 27, 2012. The entire subject matter of this priority document, including specification claims and drawings thereof, is incorporated by reference herein.

BACKGROUND OF THE INVENTION

1. Field of the Invention

The present invention relates to an intake system for a vehicle, and particularly relates to an intake system for a motorcycle.

2. Description of the Background Art

As a conventional intake system, there is a known system where, in an engine including multiple cylinder blocks arranged on the front and rear sides, an air cleaner case is partitioned into an upper side for a clean chamber and a lower side for a dirty chamber; intake passages for the respective cylinder blocks are arranged to pass through the dirty chamber in an up-down direction; inlets of the intake passages for the respective cylinder blocks are arranged in the clean chamber; and an air cleaner element configured to clean intake air is arranged in front of the intake passages for the front cylinder blocks (for example, see Patent Document 1).

[Patent Document 1] Japanese Patent No. 4421941

Problem to be Solved by the Invention

The vehicular intake system according to Patent Document 1 described above, however, has a possibility that an air cleaner assembly may increase in front-rear dimension and top-bottom dimension because the air cleaner element is arranged to stand in front of the intake passages for the front cylinder blocks.

SUMMARY OF THE INVENTION

The present invention has been made in consideration of the foregoing circumstances, and has an objective of providing a vehicular intake system which makes it possible to maintain a compact size of the air cleaner assembly, by arranging components thereof in an efficient manner.

For the purpose of solving the above-mentioned problem, a first aspect of the present invention provides a vehicular intake system comprising: a multicylinder engine including at least one front cylinder block and at least one rear cylinder block; intake passages configured to introduce intake air to the front and rear cylinder blocks, respectively; and an air cleaner assembly connected to upstream ends of the intake passages for the front and rear cylinder blocks, wherein a space inside an air cleaner case of the air cleaner assembly is partitioned into upper and lower sides by a partition wall, thereby forming a clean chamber on the upper side and a dirty chamber on the lower side, the intake passages are arranged to pass through the dirty chamber in an up-down direction, and inlets of the intake passages are arranged inside the clean chamber, a through hole is formed between the intake passages for the front and rear cylinder blocks in the partition wall, and an air cleaner element configured to clean the intake air is arranged to occlude the through hole.

In a second aspect of the present invention, in addition to the configuration of the first aspect, the engine is a V engine, and the air cleaner element is formed into a plate-like body having a longitudinal dimension that exceeds a width across outermost edges of the intake passages for the front and rear cylinder blocks.

In a third aspect of the present invention, in addition to the configuration of the first or second aspect, front and rear fuel injection valves configured to inject a fuel to the respective intake passages for the front and rear cylinder blocks are arranged in the clean chamber, and the air cleaner element is arranged below the fuel injection valves.

In a fourth aspect of the present invention, in addition to the configuration of the third aspect, a fuel supply pipe connecting the front and rear fuel injection valves to each other is arranged above the air cleaner element, and a fuel hose is detachably connected to the fuel supply pipe above the air cleaner element.

In a fifth aspect of the present invention, in addition to the configuration of the third or fourth aspect, the fuel injection valves are fuel injection valves on an upstream side, the intake system comprises throttle bodies forming the respective intake passages for the front and rear cylinder blocks and including fuel injection valves on a downstream side, respectively, and the air cleaner element is arranged between the fuel injection valves on the upstream side and the fuel injection valves on the downstream side.

In a sixth aspect of the present invention, in addition to the configuration of the fifth aspect, the air cleaner element is arranged between a fuel hose connected to the fuel injection valves on the upstream side, and a fuel hose connected to the fuel injection valves on the downstream side.

In a seventh aspect of the present invention, in addition to the configuration of any one of the third to sixth aspects, the intake system further comprises supporting members configured to support the front and rear fuel injection valves above the intake passages, and each of the supporting members is provided with an integrated alignment portion configured to align a position of the air cleaner element.

In an eighth aspect of the present invention, in addition to the configuration of the seventh aspect, the engine is an inline V engine comprising two front cylinder blocks and two rear cylinder blocks, and the alignment portions of the supporting members are arranged respectively near distant-and-opposite outer edges of the neighboring intake passages for the two front cylinder blocks, and near distant-and-opposite outer edges of the neighboring intake passages for the two rear cylinder blocks.

Effects of the Invention

According to the first aspect of the present invention, the space inside the air cleaner case of the air cleaner assembly is partitioned into the upper side and the lower side by the partition wall, thereby forming the clean chamber on the upper side and the dirty chamber on the lower side, the intake passages are arranged to pass through the dirty chamber in the up-down direction, the inlets of the intake passages are arranged in the clean chamber, the through hole is formed between the intake passages for the front and rear cylinder blocks in the partition wall, and the air cleaner element configured to clean the intake air is arranged to occlude the through hole. Thus, the air cleaner element can be arranged by using the space between the intake passages for the front and rear cylinder blocks. This makes it possible to prevent the air cleaner assembly from getting larger.

According to the second aspect of the present invention, the engine is the V engine; and the air cleaner element is formed into the plate-like body having the longitudinal dimension that exceeds the width across the outermost edges of the intake passages for the front and rear cylinder blocks. For this reason, even if the air cleaner element is arranged in the space between the narrowly-spaced intake passages, a cleaning area of the air cleaner element can be secured.

According to the third aspect of the present invention, the front and rear fuel injection valves configured to inject a fuel to the respective intake passages for the front and rear cylinder blocks are arranged in the clean chamber, and the air cleaner element is arranged below the fuel injection valves. Thus, even when the front and rear fuel injection valves are arranged in the clean chamber, the air cleaner element can be arranged in an empty space where the air cleaner element does not interfere with the front and rear fuel injection valves.

According to the fourth aspect of the present invention, the fuel supply pipe connecting the front and rear fuel injection valves to each other is arranged above the air cleaner element, and the fuel hose is detachably connected to the fuel supply pipe above the air cleaner element. Thus, in cleaning or replacement of the air cleaner element, the fuel hose can be easily detached, and thereby the air cleaner element can be easily detached.

According to the fifth aspect of the present invention, the air cleaner element is arranged between the fuel injection valves on the upstream side and the fuel injection valves on the downstream side. Thus, the air cleaner element can be arranged in an empty space where the air cleaner element does not interfere with the fuel injection valves on the upstream side and the downstream side.

According to the sixth aspect of the present invention, the air cleaner element is arranged between the fuel hose connected to the fuel injection valves on the upstream side, and the fuel hose connected to the fuel injection valves on the downstream side. Thus, in cleaning and replacement of the air cleaner element, the fuel hose on the upstream side can be easily detached and attached. In addition, since the fuel hose on the downstream side can be viewed through the through hole of the partition wall, the fuel hose on the downstream side can be easily detached and attached.

According to the seventh aspect of the present invention, the intake system further comprises the supporting members configured to support the front and rear fuel injection valves above the intake passages, respectively. Each of the supporting members is provided with the integrated alignment portion configured to align a position of the air cleaner element. Thus, there is no need to provide any additional members to align a position of the air cleaner element. This enables reduction in the number of parts, and consequently leads to reduction in manufacturing costs.

According to the eighth aspect of the present invention, the engine is the inline V engine comprising the two front cylinder blocks and the two rear cylinder blocks, and the alignment portions of the supporting members are arranged respectively near the distant-and-opposite outer edges of the neighboring intake passages for the two front cylinder blocks, and near the distant-and-opposite outer edges of the neighboring intake passages for the two rear cylinder blocks. Thus, the positions of the alignment portions fixing the air cleaner element are spaced, so that the air cleaner element can be firmly fixed.

DETAILED DESCRIPTION OF ILLUSTRATIVE EMBODIMENTS

Figure 1:
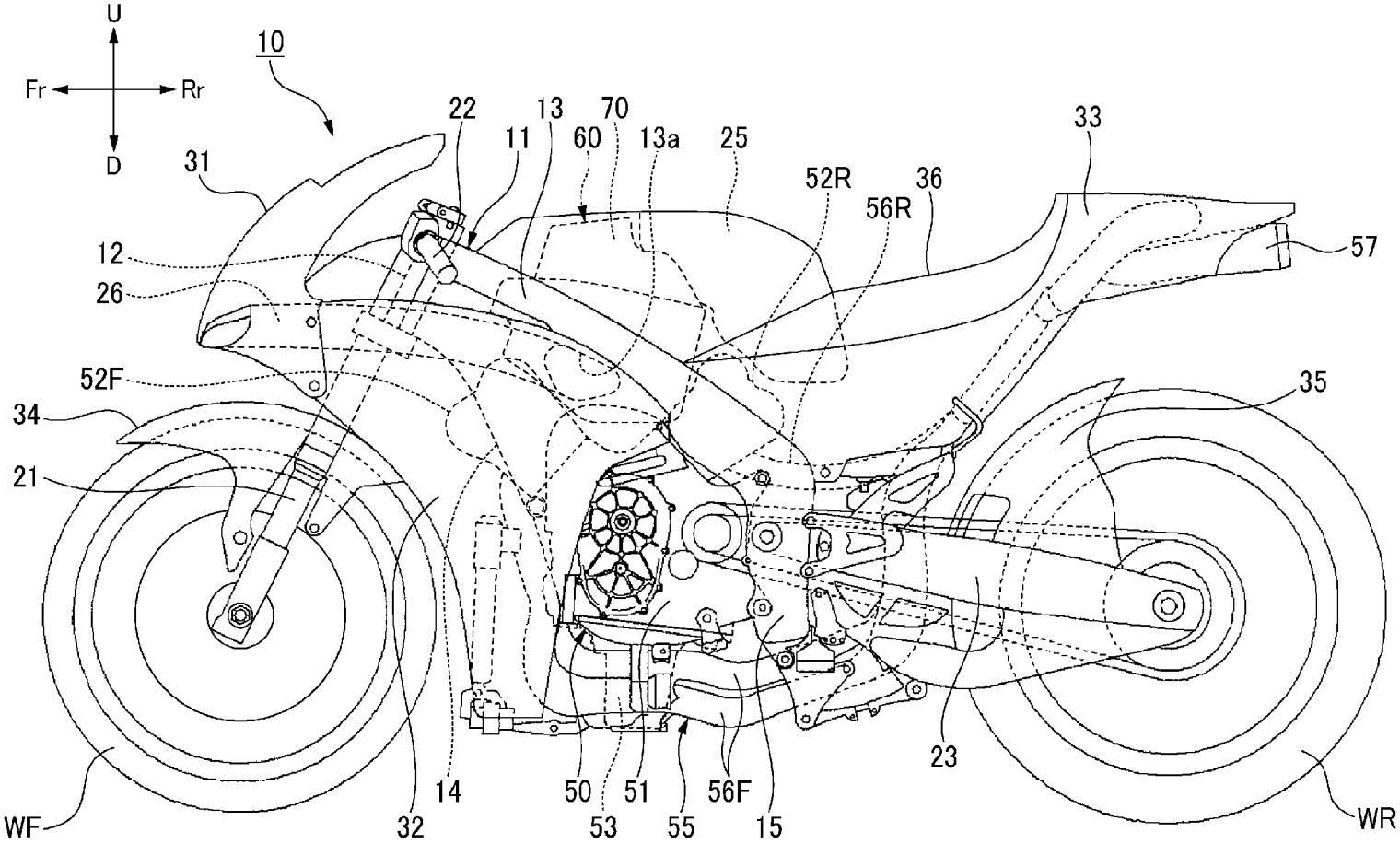
FIG. 1 is a left-side view illustrating a motorcycle equipped with an embodiment of a vehicular intake system according to the present invention.

Hereinafter, an embodiment of a vehicular intake system according to the present invention is described in detail with reference to the accompanying drawings. It should be noted that the drawings should be viewed in the same orientation as the reference numerals. In the following description, front-rear, left-right, up-down are defined according to directions viewed from a vantage point of a driver seated on the motorcycle 10 and facing forward. The drawings include directional indicia Fr, Rr, L, R, U, and D for indicating the front side, the rear side, the left side, the right side, the upper side and the lower side of a vehicle, respectively.

In a motorcycle 10 of the present embodiment, as illustrated in FIG. 1, a vehicle body frame 11 includes a head pipe 12 provided at the front end thereof, a pair of left and right main frames 13 extending rearward and downward from the head pipe 12, a pair of left and right engine hangers 14 extending downward from lower surfaces of front portions of the pair of left and right main frames 13, a pair of left and right pivot frames 15 connected to rear end portions of the pair of left and right main frames 13 and extending downward. An engine 50 is attached to the engine hangers 14 and the pivot frames 15.

Moreover, the motorcycle 10 includes a front fork 21 supported in a fully steerable manner by the head pipe 12, a front wheel WF rotatably supported by an lower end portion of the front fork 21, a steering handlebar 22 attached to an upper end portion of the front fork 21, a rear swing arm 23 pivotally supported by the pivot frames 15, a rear wheel WR rotatably supported by an rear end portion of the swing arm 23, an intake system 60 arranged between the left and right main frame 13 above the engine 50, and a fuel tank 25 arranged behind the intake system 60. Also as shown in FIG. 1, reference numeral 31 denotes a front cowl; reference numeral 32 denotes a front side cowl; reference numeral 33 denotes a rear cowl; reference numeral 34 denotes a front fender; reference numeral 35 denotes a rear fender; and reference numeral 36 denotes a seat.

In addition, the motorcycle 10 includes a pair of left and right intake ducts 26 configured to introduce intake air into the engine via an air cleaner assembly 70 of the intake system 60. Duct insertion holes 13*a* passing through the main frames 13 in a vehicle-width direction are formed in the left and right main frames 13, respectively. Through the duct insertion holes 13*a*, the left and right intake ducts 26 extend to the corresponding left and right sides of the air cleaner assembly 70, respectively.

The depicted engine 50 is a four-cylinder engine arranged in a V configuration. As illustrated in FIG. 1, the engine 50 includes a crankcase 51, a front cylinder block 52F and a rear cylinder block 52R arranged in a V-shape on front and rear sides of an upper portion of the crankcase 51, and an oil pan 53 attached to a lower surface of the crankcase 51. A left front cylinder and a right front cylinder which are not illustrated are provided inside the front cylinder block 52F, and a left rear cylinder and a right rear cylinder which are not illustrated are provided inside the rear cylinder block 52R.

The intake system 60 is connected to a rear surface of the front cylinder block 52F and a front surface of the rear cylinder block 52R. An exhaust routing assembly 55 is connected to a front surface of the front cylinder block 52F and also to a rear surface of the rear cylinder block 52R.

The exhaust routing assembly 55 includes a front outlet pipe 56F connected to an exhaust port of the front cylinder block 52F, a rear outlet pipe 56R connected to an exhaust port of the rear cylinder block 52R, and a muffler 57 connected to downstream ends of the front and rear outlet pipes 56F, 56R.

As illustrated in FIGS. 2 to 5, the intake system 60 includes a left front throttle body 61FL and a right front throttle body 61FR connected to a left front cylinder and a right front cylinder of the front cylinder block 52F, respectively, a left rear throttle body 61RL and a right rear throttle body 61RR connected to a left rear cylinder and a right rear cylinder of the rear cylinder block 52R, respectively, and the air cleaner assembly 70 connected to upstream ends of the left front and right front throttle bodies 61FL, 61FR and the left rear and right rear throttle bodies 61RL, 61RR.

Figure 4:
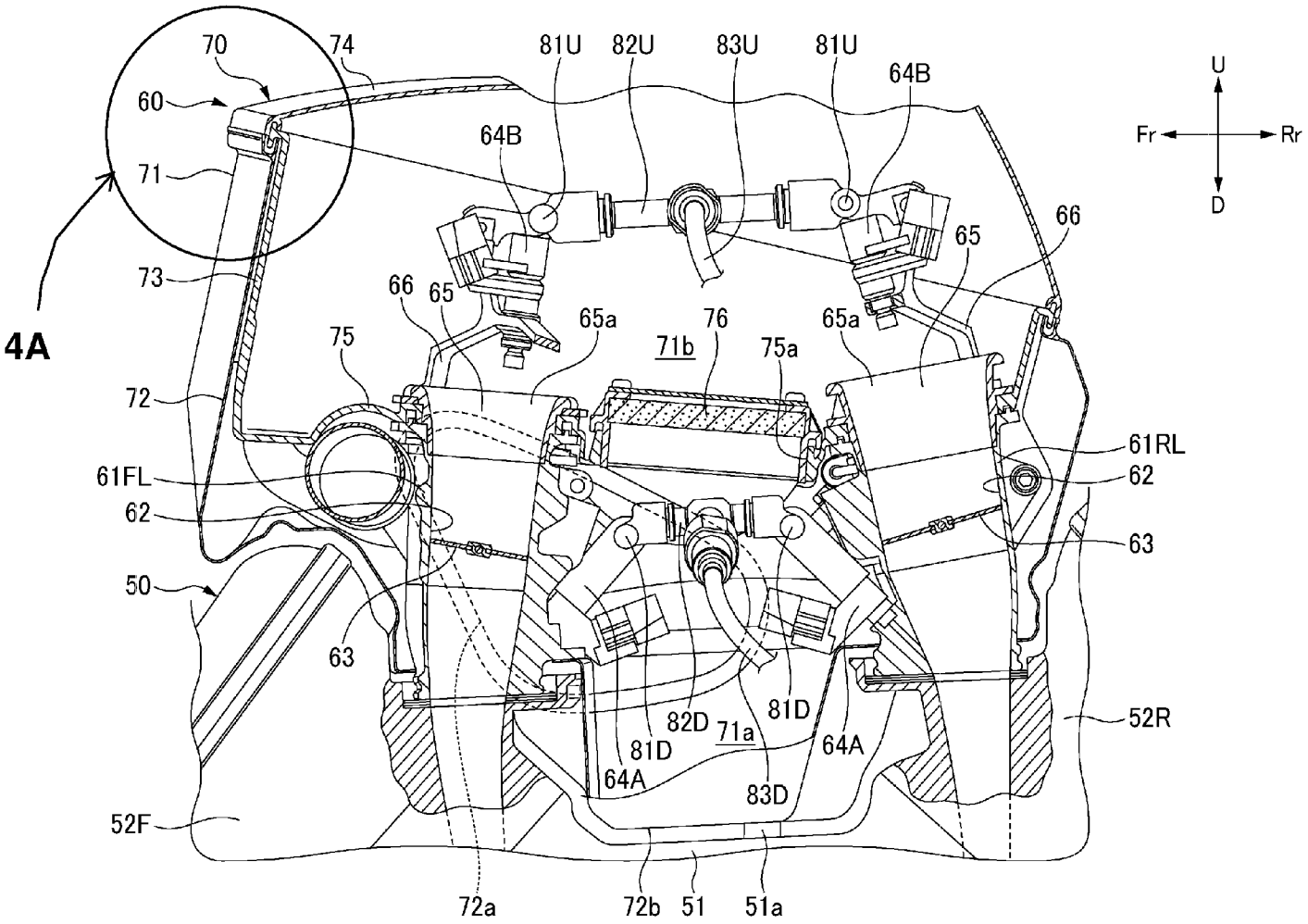
FIG. 4 is a cross sectional view of the intake system of FIG. 2, taken along a line A-A.

As illustrated in FIG. 4, the left front throttle body 61FL includes an intake passage 62 configured to introduce intake air to the left front cylinder of the front cylinder block 52F, a throttle plate 63 configured to open and close the intake passage 62, a lower fuel injection valve (fuel injection valve on a downstream side) 64A configured to inject a fuel into the intake passage 62, and an air funnel 65 attached to an upstream end of the intake passage 62 and constituting a part of the intake passage 62. Here, the right front throttle body 61FR is configured to have a similar structure to the left front throttle body 61FL.

As illustrated in FIG. 4, the left rear throttle body 61RL includes an intake passage 62 configured to introduce intake air to the left rear cylinder of the rear cylinder block 52R, a throttle plate 63 configured to open and close the intake passage 62, a lower fuel injection valve (fuel injection valve on the downstream side) 64A configured to inject the fuel into the intake passage 62, and an air funnel 65 attached to an upstream end of the intake passage 62 and constituting a part of the intake passage 62. Here, the right rear throttle body 61RR is configured to have a similar structure to the left rear throttle body 61RL.

As illustrated in FIGS. 2 to 5, the air cleaner assembly 70 includes an air cleaner case 71 having a two-tiered structure including upper and lower layers. This air cleaner case 71 includes an outer case member constituting a lower case 72, an inner case member constituting a upper case 73 fitted into the lower case 72 from above, and forming a dirty chamber 71*a* between the upper case 73 and the lower case 72, and a lid portion 74 forming a clean chamber 71*b* between the lid portion 74 and the upper case 73 by occluding an upper opening of the upper case 73.

Figure 4A:
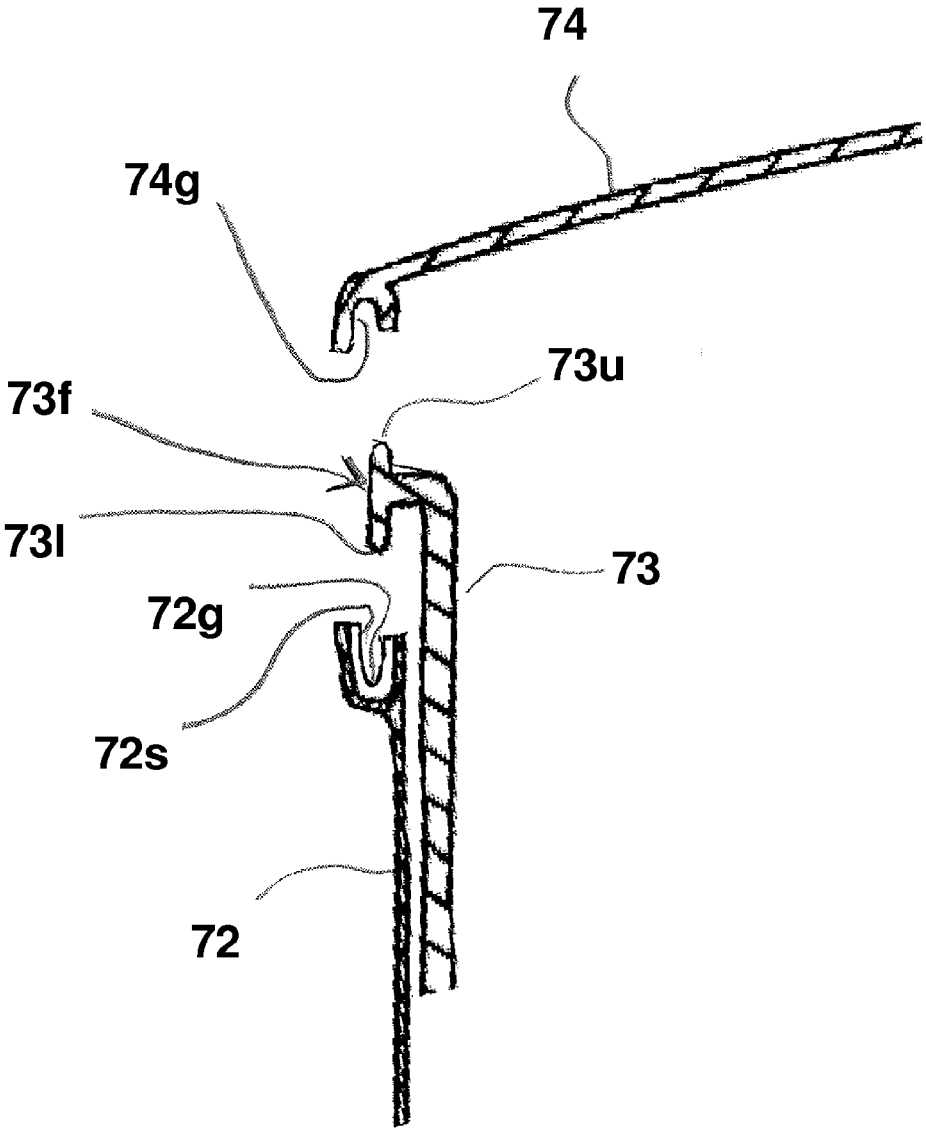
FIG. 4A is an exploded detail view of a portion of an air cleaner housing which is a component of the intake system of FIG. 4 shown within the circular area designated as 4A.

With reference to FIG. 4*a*, it will be seen that in the depicted embodiment, the lid portion 74 has a circumferentially extending lower edge with a first grooved channel 74*g* formed therein and facing downwardly. Also, the lower (outer) case 72 has an upper edge with a second grooved channel 72*g* formed therein and facing upwardly. Optionally, the lower (outer) case 72 may have a seal or gasket 72*s* disposed therein and having a C-shaped cross-section. The inner (upper) case 73 has an upper edge with a transverse T-shaped flange 73*f* thereon, the flange including an upper rib 73*u* configured to fit into the first grooved channel 74*g* of the lid, and a lower rib 73*l* configured to fit into the second grooved channel 72*g* of the outer (lower)) case 72.

It will be seen from the foregoing discussion, in connection with FIGS. 4 and 4*a*, that with the air cleaner case 71 having the described structure, the relative position of the inner (upper) case 73 can be aligned with respect to the outer (lower) case by placing the lower rib 73*l* of the T-shaped flange 73*f* into the second grooved channel 72*g* of the outer (lower)) case 72, and then the lid portion may be placed over the upper rib, as shown.

A bottom plate (partition plate) 75 of the upper case 73 forms a partition wall that partitions the space inside the air cleaner case 71 into the upper and lower sides defining the clean chamber 71*b* and the dirty chamber 71*a*, respectively. With this structure, the clean chamber 71*b* is formed above the partition plate 75 on the upper side of the air cleaner case 71, and the dirty chamber 71*a* is formed below the partition plate on the lower side of the air cleaner case.

Moreover, the left and right front throttle bodies 61FL, 61FR, the left and right rear throttle bodies 61RL, 61RR, and the air funnels 65 are arranged to pass through the dirty chamber 71*a* of the air cleaner case 71 in the up-down direction, and inlets 65*a* of the air funnels 65, which are inlets of the intake passages 62, are arranged in the clean chamber 71*b* formed in the upper portion of the air cleaner case 71, as shown.

Figure 2:
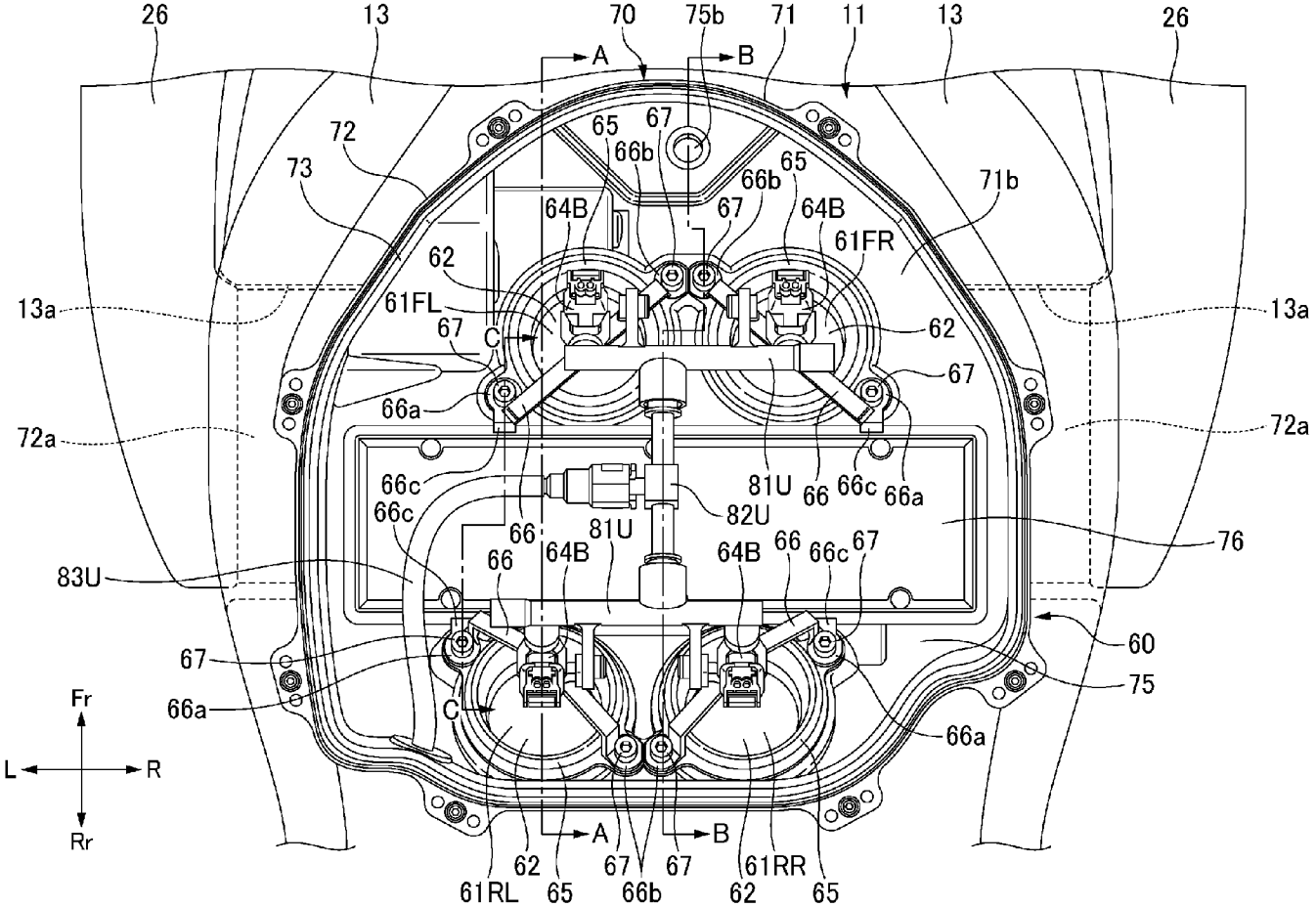
FIG. 2 is an upper side view of the intake system illustrated in FIG. 1, with a lid portion omitted from the drawing for illustrative purposes.

Then, as illustrated in FIGS. 2 and 4, a through hole 75*a*, having an oblong shape extending in the vehicle width direction, is formed in the bottom plate 75 of the upper case 73. The through hole 75*a* is disposed between the front throttle bodies 61FL, 61FR and the rear and throttle bodies 61RL, 61RR. An air cleaner element 76, configured to clean dirt particles and other contaminants from the incoming intake air, is arranged to occlude the through hole 75*a*.

The air cleaner element 76 is formed into an oblong plate-like body having a longitudinal dimension (the dimension in the vehicle width direction) that exceeds a width across the outermost edges of the intake passages 62 of the left front and right front throttle bodies 61FL, 61FR. Similarly, the length of the air cleaner element exceeds a width across the outermost edges of the intake passages 62 of the left rear and right rear throttle bodies 61RL, 61RR.

Figure 3:
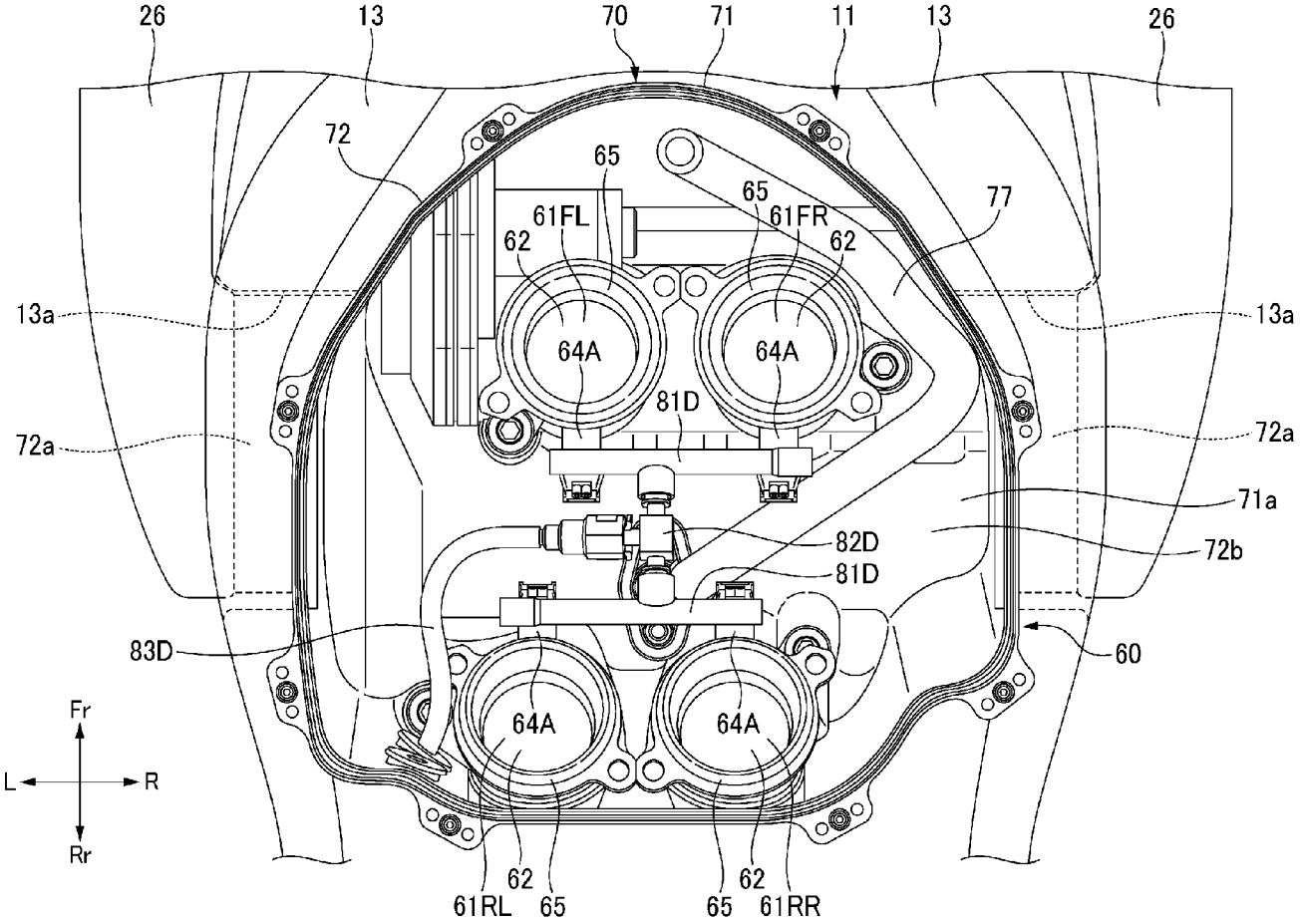
FIG. 3 is an upper view of the intake system illustrated in FIG. 2, with an upper case additionally removed from the drawing for illustrative purposes.

In addition, as illustrated in FIGS. 3 and 4, duct connection portions 72*a* are formed in left and right side walls of the lower case 72, respectively. Downstream-side ends of the intake ducts 26 are connected to the duct connection portions 72*a*.

Moreover, as illustrated in FIGS. 2 and 4, upper fuel injection valves (fuel injection valves on the upstream side) 64B configured to inject the fuel into the respective intake passages 62 are arranged respectively above the left and right front throttle bodies 61FL, 61FR and above the left and right rear throttle bodies 61RL, 61RR, respectively. Each of the upper fuel injection valves 64B is supported by a corresponding supporting bracket 66, provided above and extending across the respective intake passages 62. Each of the supporting brackets 66 is fixed with two bolts 67 to an upper end portion of the corresponding one of the throttle bodies 61FL, 61FR, 61RL, 61RR. The upper fuel injection valves 64B are arranged in the clean chamber 71*b* of the air cleaner case 71.

As illustrated in FIGS. 2 and 4, the air cleaner assembly 70 includes a first fuel supply pipe 81U connected to the upper fuel injection valves 64B, 64B of the left and right front throttle bodies 61FL, 61FR and extending in the vehicle width direction, a first fuel supply pipe 81U connected to the upper fuel injection valves 64B, 64B of the left and right rear throttle bodies 61RL, 61RR and extending in the vehicle width direction, a second fuel connector pipe 82U connecting the first fuel supply pipes 81U, 81U to each other, and a fuel hose 83U detachably connected to approximately the center of the second fuel connector pipe 82U. Thus, the upper fuel injection valves 64B, 64B on the front side and the upper fuel injection valves 64B, 64B on the rear side are connected to each other by the first fuel supply pipes 81U, 81U and the second fuel connector pipe 82U.

In addition, the first fuel supply pipes 81U, 81U and the second fuel connector pipe 82U are arranged above the air cleaner element 76, and the fuel hose 83U is detachably connected to the second fuel connector pipe 82U above the air cleaner element 76.

Meanwhile, as illustrated in FIGS. 3 and 4, the air cleaner assembly 70 includes a first fuel supply pipe 81D connected to the lower fuel injection valves 64A, 64A of the left and right front throttle bodies 61FL, 61FR and extending in the vehicle width direction, a first fuel supply pipe 81D connected to the lower fuel injection valves 64A, 64A of the left and right rear throttle bodies 61RL, 61RR and extending in the vehicle width direction, a second fuel connector pipe 82D connecting the first fuel supply pipes 81D, 81D to each other, and a fuel hose 83D detachably connected to approximately the center of the second fuel connector pipe 82D. Thus, the lower fuel injection valves 64A, 64A on the front side and the lower fuel injection valves 64A, 64A on the rear side are connected to each other by the first fuel supply pipes 81D, 81D and the second fuel connector pipe 82D.

In addition, the first fuel supply pipes 81D, 81D and the second fuel connector pipe 82D are arranged below the air cleaner element 76, and the fuel hose 83D is detachably connected to the second fuel connector pipe 82D below the air cleaner element 76.

Thus, the air cleaner element 76 is situated at a level between the upper and lower fuel injection valves 64B, 64A, and is also arranged between the fuel hose 83U arranged on the upper side and the fuel hose 83D arranged on the lower side. Hence, the air cleaner element 76 is arranged below the upper fuel injection valves 64B and above the lower fuel injection valves 64A.

Moreover, as illustrated in FIG. 2, pierced flanges 66*a*, 66*b* are respectively formed at two opposite edge portions of each of the supporting brackets 66 supporting the upper fuel injection valves 64B. The pierced flanges 66*a*, 66*b* are fixed to each of the throttle bodies 61FL, 61FR, 61RL, 61RR with the bolts 67. Each of the supporting brackets 66 is arranged obliquely with respect to a vehicle front-rear direction such that the pierced flange 66*a* on an outer side in the vehicle width direction is located at a position adjacent to the air cleaner element 76, while the pierced flange 66*b* on an inner side in the vehicle width direction is located at a position spaced away from the air cleaner element 76.

Figure 6:
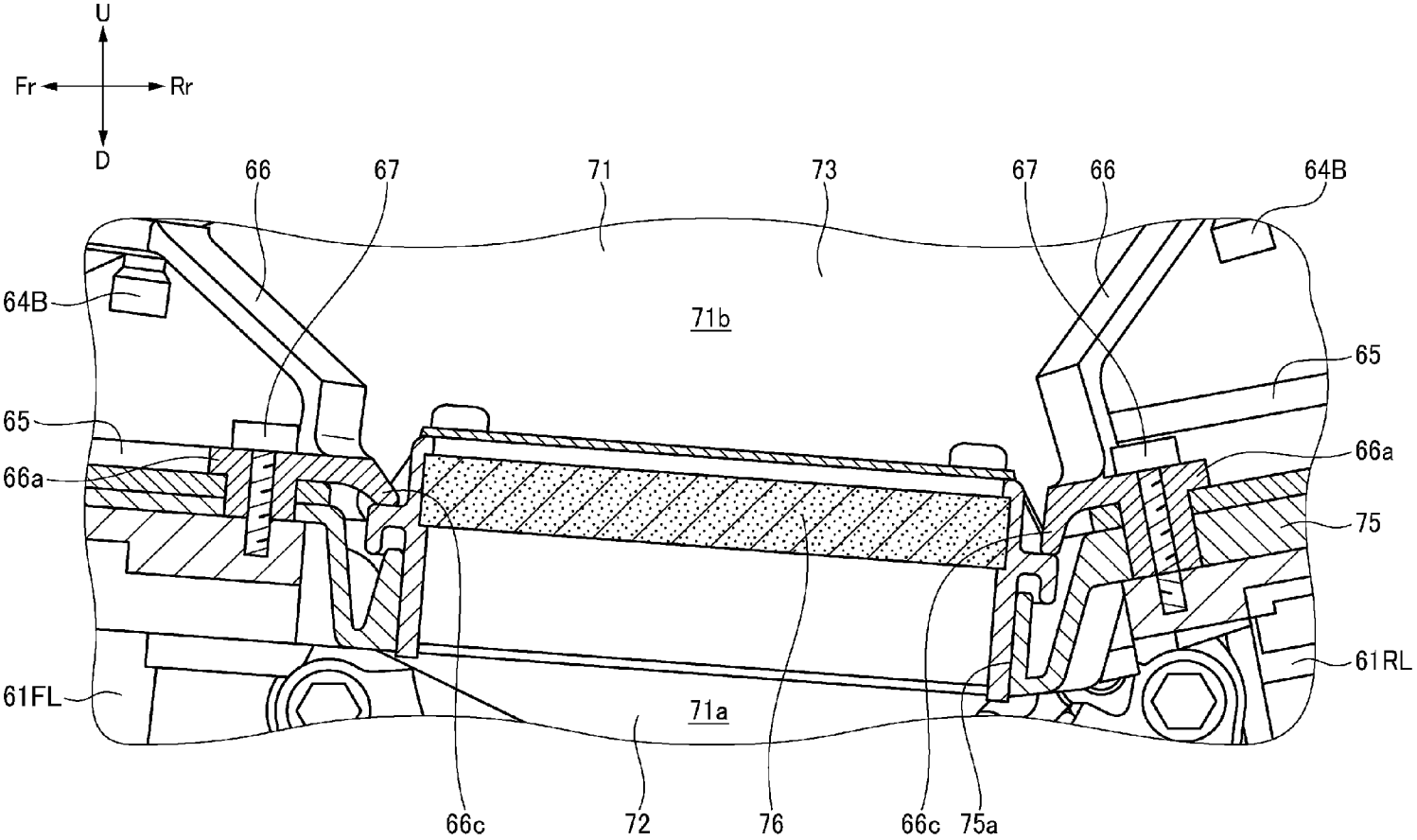
FIG. 6 is a cross sectional detail view of a portion of the intake system of FIG. 5.

As illustrated in FIGS. 2 and 6, a fixture piece (alignment portion) 66*c* is formed integrally at the pierced flange 66*a* of the supporting bracket 66 on the outer side in the vehicle width direction. The fixture piece 66*c* fixes an installed position of the air cleaner element 76 by pressing down on an edge portion of the air cleaner element 76 from above. For this purpose, the fixture pieces 66*c* are respectively arranged near distant-and-opposite outer edges of the intake passages 62 of the left front and right front throttle bodies 61FL, 61FR neighboring in the left-right direction, and near distant-and-opposite outer edges of the intake passages 62 of the left rear and right rear throttle bodies 61RL, 61RR neighboring in the left-right direction.

In the air cleaner assembly 70 configured as described above, when the eight bolts 67 are unscrewed and thereby the four supporting brackets 66 are detached, the fixation of the air cleaner element 76 is released and the air cleaner element 76 can be removed for cleaning or replacement.

Figure 5:
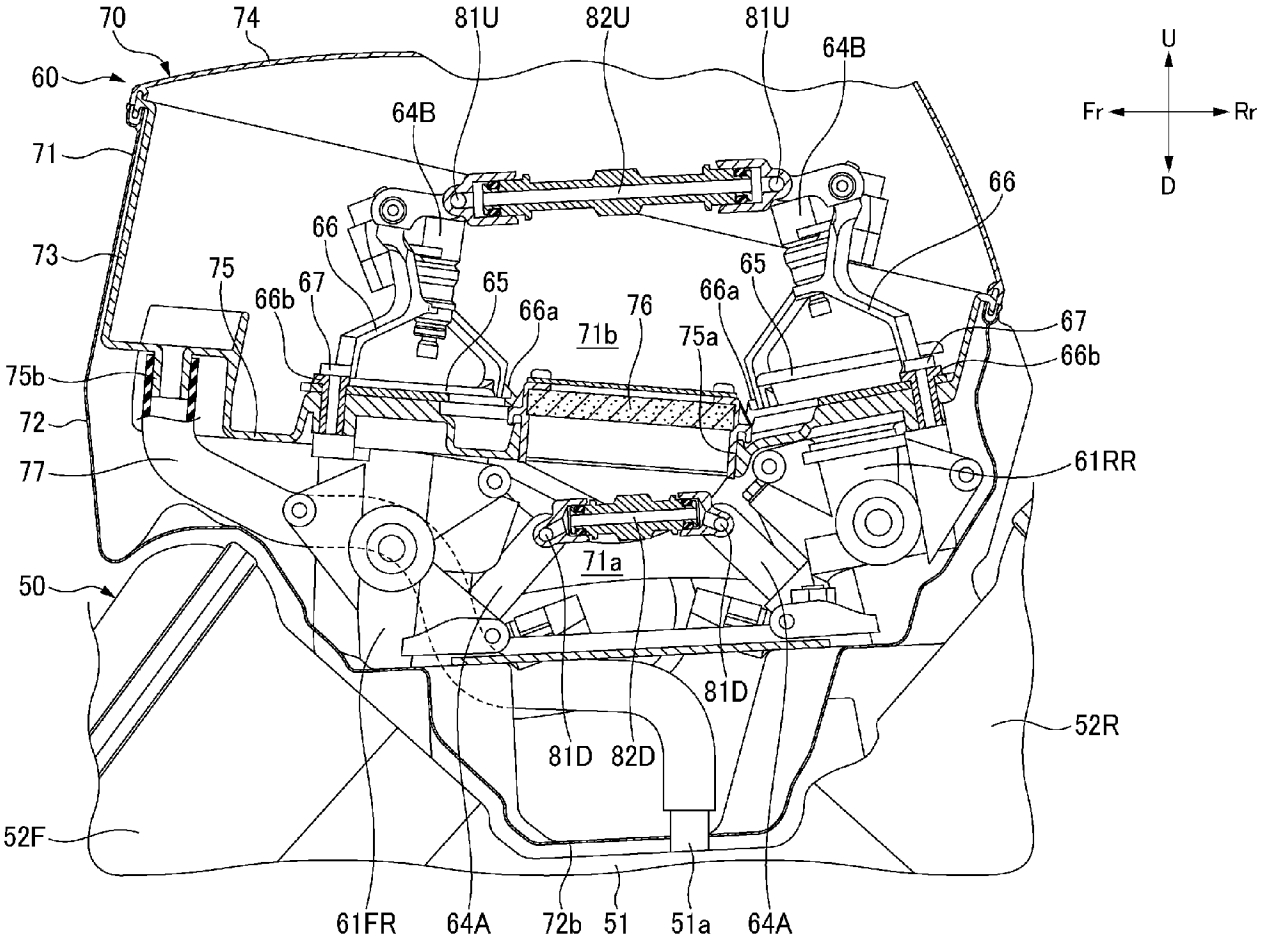
FIG. 5 is a cross sectional view of the intake system of FIG. 2, taken along a line B-B.

Moreover, as illustrated in FIGS. 3 and 5, a cylindrical gas outlet portion 51*a*, configured to discharge a blowby gas, is provided to protrude between the front and rear cylinder blocks 52F, 52R on the upper surface of the crankcase 51 of the engine 50. The gas outlet portion 51*a* is arranged to extend through a bottom plate 72*b* of the lower case 72 of the air cleaner case 71 to the inside of the dirty chamber 71*a*. Then, a gas outlet hose 77 is connected to the gas outlet portion 51*a*. A downstream end of this gas outlet hose 77 is connected to a joint 75*b* formed in the bottom plate 75 of the upper case 73 of the air cleaner case 71 and communicating with the clean chamber 71*b*. As a result, the blowby gas from the crankcase 51 is discharged into the clean chamber 71*b* via the gas outlet hose 77.

As described above, according to the vehicular intake system 60 of the present embodiment, the through hole 75*a* is formed between the left and right front throttle bodies 61FL, 61FR and the left and right rear throttle bodies 61RL, 61RR in the bottom plate 75 of the upper case 73 of the air cleaner case 71, and the air cleaner element 76 is arranged to occlude the through hole 75*a*. Thus, the air cleaner element 76 can be arranged by using a space between the front throttle bodies 61FL, 61FR and the rear throttle bodies 61RL, 61RR. This makes it possible to maintain a small size of the air cleaner assembly 70.

Moreover, according to the vehicular intake system 60 of the present embodiment, the air cleaner element 76 is formed into the plate-like body having the longitudinal dimension that exceeds the width across the outermost edges of the intake passages 62 of the left front and right front throttle bodies 61FL, 61FR and the left rear and right rear throttle bodies 61RL, 61RR. Accordingly, even when the air cleaner element 76 is arranged in the space between the left front and right front throttle bodies 61FL, 61FR and the left rear and right rear throttle bodies 61RL, 61RR, which are narrowly spaced, the cleaning area of the air cleaner element 76 can be secured.

Further, according to the vehicular intake system 60 of the present embodiment, the air cleaner element 76 is arranged below the upper fuel injection valves 64B. Thus, even when the upper fuel injection valves 64B are arranged in the clean chamber 71*b*, the air cleaner element 76 can be arranged in an empty space where the air cleaner element 76 does not interfere with the upper fuel injection valves 64B.

Additionally, according to the vehicular intake system 60 of the present embodiment, the first and second fuel supply pipes 81U, 82U connecting the front and rear upper fuel injection valves 64B to each other are arranged above the air cleaner element 76, and the fuel hose 83U is detachably connected to the second fuel connector pipe 82U above the air cleaner element 76. Thus, in the cleaning or replacement of the air cleaner element 76, the fuel hose 83U can be easily detached and thereby the air cleaner element 76 can be easily detached.

In addition, according to the vehicular intake system 60 of the present embodiment, the air cleaner element 76 is arranged between the upper fuel injection valves 64B on the upstream side, and the lower fuel injection valves 64A on the downstream side. Thus, the air cleaner element 76 can be arranged in an empty space where the air cleaner element 76 does not interfere with the first and upper fuel injection valves 64A, 64B.

Still further, according to the vehicular intake system 60 of the present embodiment, the air cleaner element 76 is arranged between the fuel hose 83U connected to the upper fuel injection valves 64B on the upstream side, and the fuel hose 83D connected to the lower fuel injection valves 64A on the downstream side. Thus, in the cleaning or replacement of the air cleaner element 76, the fuel hose 83U on the upstream side can be easily detached and attached. In addition, since the fuel hose 83D on the downstream side can be viewed through the through hole 75*a* of the bottom plate 75 of the upper case 73, the fuel hose 83D on the downstream side can be easily detached and attached.

Yet further, according to the vehicular intake system 60 of the present embodiment, the fixture pieces 66*c* to align a position of the air cleaner element 76 are formed integrally in the supporting brackets 66 to support the upper fuel injection valves 64B. Thus, there is no need to provide any additional members to align a position of the air cleaner element 76. This enables reduction in the number of parts, and consequently leads to reduction in manufacturing costs.

Still furthermore, according to the vehicular intake system 60 of the present embodiment, the fixture pieces 66*c* of the supporting brackets 66 are arranged respectively near distant-and-opposite outer edges of the intake passages 62 of the left front and right front throttle bodies 61FL, 61FR neighboring in the left-right direction, and near distant-and-opposite outer edges of the intake passages 62 of the left rear and right rear throttle bodies 61RL, 61RR neighboring in the left-right direction. Thus, the positions of the fixture pieces 66*c* fixing the air cleaner element 76 are spaced, so that the air cleaner element 76 can be firmly fixed.

It should be noted that the present invention must not be limited to that illustrated in the foregoing embodiment, but may be modified as needed without deviating from the scope of the present invention.

For example, in the present embodiment, the fixture pieces 66*c* to align a position of the air cleaner element 76 are provided integrally in the supporting brackets 66 to support the upper fuel injection valves 64B. However, the present invention is not limited to this. The fixture pieces 66*c* may be provided as pieces separate from the supporting brackets 66.

In addition, the present embodiment illustrates the case where the present invention is applied to a four-cylinder V-type engine. However, the present invention is not limited to this. The present invention may be applied to a V-twin engine.

In other words, although the present invention has been described herein with respect to a specific illustrative embodiment, the foregoing description is intended to illustrate, rather than to limit the invention. Those skilled in the art will realize that many modifications of the illustrative embodiment could be made which would be operable. All such modifications, which are within the scope of the appended claims, are intended to be within the scope and spirit of the present invention.

What is claimed is:

1. A vehicular intake system comprising:

a multicylinder engine including at least one front cylinder block and at least one rear cylinder block;

a plurality of intake passages configured to introduce intake air to the front and rear cylinder blocks, respectively, the engine comprising a plurality of air funnels defining portions of the intake passages, including at least one front air funnel for introducing air to the front cylinder block and at least one rear air funnel for introducing air to the rear cylinder block; and an air cleaner assembly connected to upstream ends of the intake passages for the front and rear cylinder blocks, the air cleaner assembly comprising an air cleaner case and an air cleaner element disposed inside of the case;

wherein:

a space inside of the air cleaner case is partitioned into upper and lower parts by a partition wall, thereby forming a clean chamber on the upper side and a dirty chamber on the lower side, the intake passages are arranged to pass through the dirty chamber in a vertical direction, and inlets of the intake passages are arranged in the clean chamber, a through hole is formed in the partition wall between the front and rear air funnels for the front and rear cylinder blocks, respectively, and an air cleaner element configured to clean the intake air is arranged to occlude the through hole, the air cleaner element arranged substantially horizontally between the front and rear air funnels.

2. The vehicular intake system according to claim 1, wherein the engine is a V engine, and the air cleaner element comprises a plate-like body having a longitudinal dimension that exceeds a width across outermost edges of the intake passages for each of the front and rear cylinder blocks.

3. The vehicular intake system according to claim 1, wherein front and rear fuel injection valves configured to inject a fuel to the respective intake passages for the front and rear cylinder blocks are arranged in the clean chamber, and the air cleaner element is arranged below the fuel injection valves.

4. The vehicular intake system according to claim 3, wherein a fuel supply pipe connecting the front and rear fuel injection valves to each other is arranged above the air cleaner element, and a fuel hose is detachably connected to the fuel supply pipe above the air cleaner element.

5. The vehicular intake system according to claim 3, wherein:

the fuel injection valves are upper fuel injection valves situated on an upstream side of the intake passages, the intake system comprises throttle bodies each having a respective intake passage formed therein for one of the front and rear cylinder blocks, and each having a lower fuel injection valve attached thereto on a downstream side, and the air cleaner element is arranged at a level between the upper fuel injection valves and the lower fuel injection valves.

6. The vehicular intake system according to claim 5, wherein the air cleaner element is arranged between a fuel hose connected to the fuel injection valves on the upstream side, and a fuel hose connected to the fuel injection valves on the downstream side.

7. The vehicular intake system according to claim 3, further comprising a plurality of supporting members configured to support the front and rear fuel injection valves above the intake passages, respectively, wherein each of the supporting members is provided with an air cleaner alignment portion configured to align an installed position of the air cleaner element.

8. The vehicular intake system according to claim 7, wherein the engine is arranged in a V-shaped configuration comprising two front cylinder blocks and two rear cylinder blocks, and the alignment portions of the supporting members are arranged respectively near distant-and-opposite outer edges of the neighboring intake passages for the two front cylinder blocks, and near distant-and-opposite outer edges of the neighboring intake passages for the two rear cylinder blocks.

9. The vehicular intake system according to claim 1, wherein:

the air cleaner case comprises:

an outer case member which substantially surrounds and encloses the air funnels, an inner case member which fits inside of the outer case member, the inner case member comprising a floor portion which defines said partition wall, and a lid portion which covers the inner and outer case members.

10. The vehicular intake system according to claim 9, wherein:

the lid portion has a lower edge with a first grooved channel formed therein and facing downwardly;

the outer case has an upper edge with a second grooved channel formed therein and facing upwardly; and the inner case has an upper edge with a transverse T-shaped flange thereon, the flange comprising an upper rib configured to fit into the first grooved channel of the lid, and a lower rib configured to fit into the second grooved channel of the outer case, whereby the relative position of the inner case can be aligned with respect to the outer case by placing the lower rib of the transverse T-shaped flange into the second grooved channel.

11. A vehicular intake system comprising:

a multicylinder engine formed in a V configuration and including at least one front cylinder block and at least one rear cylinder block;

a plurality of intake passages configured to introduce intake air to the front and rear cylinder blocks, respectively, the engine comprising a plurality of air funnels defining portions of the intake passages including at least one front air funnel for introducing air to the front cylinder block and at least one rear air funnel for introducing air to the rear cylinder block; and an air cleaner assembly disposed in a space formed between the front and rear cylinder blocks and fluidly connected to upstream ends of the intake passages for the front and rear cylinder blocks, the air cleaner assembly comprising an air cleaner case and an air cleaner element disposed inside of the case, the air cleaner case comprising:

an outer case member which substantially surrounds and encloses the air funnels;

an inner case member which fits inside of the outer case member, the inner case member comprising a floor portion which defines a partition wall; and a lid portion which covers the inner and outer case members;

wherein:

a space inside of the air cleaner case is partitioned into upper and lower parts by said partition wall, thereby forming a clean chamber on the upper side of the partition wall and a dirty chamber on the lower side, the intake passages are arranged to pass through the dirty chamber in a vertical direction, and inlets of the intake passages are arranged in the clean chamber, a through hole is formed between the intake passages for the front and rear cylinder blocks in the partition wall, and the air cleaner element is arranged to occlude the through hole, the air cleaner element arranged substantially horizontally between the air funnels for the front and rear cylinder blocks, respectively.

12. The vehicular intake system according to claim 11, wherein the air cleaner element comprises a plate-like body having a longitudinal dimension that exceeds a width across outermost edges of the intake passages for each of the front and rear cylinder blocks.

13. The vehicular intake system according to claim 11, wherein front and rear fuel injection valves configured to inject a fuel to the respective intake passages for the front and rear cylinder blocks are arranged in the clean chamber, and the air cleaner element is arranged below the fuel injection valves.

14. The vehicular intake system according to claim 13, wherein a fuel supply pipe connecting the front and rear fuel injection valves to each other is arranged above the air cleaner element, and a fuel hose is detachably connected to the fuel supply pipe above the air cleaner element.

15. The vehicular intake system according to claim 13, wherein:

the fuel injection valves are upper fuel injection valves situated on an upstream side of the intake passages, the intake system comprises throttle bodies each having a respective intake passage formed therein for one of the front and rear cylinder blocks, and each having a lower fuel injection valve attached thereto on a downstream side, and the air cleaner element is arranged at a level between the upper fuel injection valves and the lower fuel injection valves.

16. The vehicular intake system according to claim 15, wherein the air cleaner element is arranged between a fuel hose connected to the fuel injection valves on the upstream side, and a fuel hose connected to the fuel injection valves on the downstream side.

17. The vehicular intake system according to claim 13, further comprising a plurality of supporting members configured to support the front and rear fuel injection valves above the intake passages, respectively, wherein each of the supporting members is provided with an air cleaner alignment portion configured to align an installed position of the air cleaner element.

18. The vehicular intake system according to claim 17, wherein the engine comprises two front cylinder blocks and two rear cylinder blocks, and the alignment portions of the supporting members are arranged respectively near distant-and-opposite outer edges of the neighboring intake passages for the two front cylinder blocks, and near distant-and-opposite outer edges of the neighboring intake passages for the two rear cylinder blocks.

19. The vehicular intake system according to claim 11, wherein:

the lid portion has a lower edge with a first grooved channel formed therein and facing downwardly;

the outer case has an upper edge with a second grooved channel formed therein and facing upwardly; and the inner case has an upper edge with a transverse T-shaped flange thereon, the flange comprising an upper rib configured to fit into the first grooved channel of the lid, and a lower rib configured to fit into the second grooved channel of the outer case, whereby the relative position of the inner case can be aligned with respect to the outer case by placing the lower rib of the transverse T-shaped flange into the second grooved channel.

20. A vehicular intake system comprising:

a multicylinder engine including at least one front cylinder block and at least one rear cylinder block, the engine comprising a plurality of air funnels defining portions of the intake passages, including at least one front air funnel for introducing air to the front cylinder block and at least one rear air funnel for introducing air to the rear cylinder block;

a plurality of intake passages configured to introduce intake air to the front and rear cylinder blocks, respectively; and an air cleaner assembly connected to upstream ends of the intake passages for the front and rear cylinder blocks, the air cleaner assembly comprising an air cleaner case and an air cleaner element disposed inside of the case;

wherein:

a space inside of the air cleaner case is partitioned into upper and lower parts by a partition wall, thereby forming a clean chamber on the upper side and a dirty chamber on the lower side, the air cleaner case is configured to admit intake air into the dirty chamber and route it upwardly through the air cleaner element to the clean chamber, the intake passages are arranged to pass through the dirty chamber in a vertical direction, and inlets of the intake passages are arranged in the clean chamber, a through hole is formed between the intake passages for the front and rear cylinder blocks in the partition wall, an air cleaner element configured to clean the intake air is arranged to occlude the through hole, front and rear upper fuel injection valves, configured to inject a fuel to the respective intake passages for the front and rear cylinder blocks, are arranged inside of the air cleaner assembly in the clean chamber, the engine further comprises a plurality of supporting bracket members disposed inside of the air cleaner case, operatively attached to the air funnels and configured to support the front and rear fuel injection valves above the intake passages, respectively, each of the supporting bracket members provided with an air cleaner alignment portion configured to contact and align the air cleaner element in an installed position thereof, and the air cleaner element is arranged at a level below the upper fuel injection valves.

* * * * *